United States Patent [19]

Stemmle

[11] Patent Number: 5,042,791

[45] Date of Patent: Aug. 27, 1991

[54] SHORT EDGE FEED DUPLEX WITH SIDE SHIFTING INVERTER

[75] Inventor: Denis J. Stemmle, Webster, N.Y.

[73] Assignee: Xerox Corporation, Stamford, Conn.

[21] Appl. No.: 406,486

[22] Filed: Sep. 13, 1989

[51] Int. Cl.[5] ..... B65H 5/06

[52] U.S. Cl. ..... 271/186; 271/291

[58] Field of Search ..... 271/186, 291, 225, 65; 355/318, 319, 320

[56] References Cited

U.S. PATENT DOCUMENTS

| | | | |
|---|---|---|---|
| 4,019,435 | 4/1977 | Davis | 271/225 X |
| 4,036,488 | 7/1977 | Allen | 271/186 |
| 4,050,805 | 9/1977 | Hage | 355/14 |
| 4,201,377 | 5/1980 | Honegger | 271/225 |
| 4,660,963 | 4/1987 | Stemmle | 355/24 |
| 4,699,503 | 10/1987 | Hyltoft | 355/14 SH |
| 4,708,462 | 11/1987 | Stemmle | 355/24 |
| 4,727,397 | 2/1988 | Stemmle | 355/24 |
| 4,733,857 | 3/1988 | Feldeisen | 271/186 X |

FOREIGN PATENT DOCUMENTS 172165 8/1986 Japan .

OTHER PUBLICATIONS

XDJ, E. R. Brooke, I. G. Brown, Duplex Photocopier, Jan., Feb. 1979, 1 page.

XDJ, Thomas Acquaviva, Document Reverter, Jan., Feb. 1982, 1 page.

*Primary Examiner*—Richard A. Schacher

[57] ABSTRACT

An automatic printing machine for producing successive duplex prints on a print substrate feeds successive print substrates to an image forming machine to form an image on a first side of successive print substrates and has a substrate transport path to transport successive substrates having images on a first side through the image forming machine to form images on the opposite side of the substrate. The substrate transport path includes an inverter to invert each successive substrate, twice about an axis perpendicular to the direction of the transport path, a side shifting inverter to invert successive substrates once about an axis parallel to the transport path direction with the corners of successive substrates entering and exiting the side shifting inverter being overlapped by substrates being transported in the path direction through the inverter. In a preferred embodiment the inverter portion of the duplex path is in a removable cassette which is interchangeable with a print substrate cassette.

34 Claims, 11 Drawing Sheets

SHORT EDGE FEED DUPLEX WITH SIDE SHIFTING INVERTER

CROSS REFERENCE TO RELATED APPLICATION

Attention is directed to U.S. application Ser. No. 07/406,491 entitled "DUPLEX FEEDER WITH SHIFTING INVERSION" filed concurrently herewith in the name of John H. Looney and commonly assigned to the assignee of the present application.

BACKGROUND OF THE INVENTION

The present invention relates to print substrate handling and duplex reproduction and more particularly to a short edge feed duplex operation producing book style duplex prints.

In an electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle.

Duplex copying, i.e. copying image information to both sides of a single sheet of paper, is an important feature in copying machines. Duplex copying is desirable because it reduces the amount of paper required in copying in comparison to simplex (single side) copying, produces attractive copy sets, and can simulate the appearance of a printed book. Generally, such copying is accomplished in either one of two methods. In a first method, first side copies are produced in a reproduction processor and stacked in a duplex tray. When a set of first side copies is complete, the copies are fed out of the duplex tray and returned to the reproduction processor with an odd number of inversions in the total duplex path to receive second side image information, and subsequently passed to an output. Alternatively, first side copies may each be returned directly to the reproduction processor to receive second side copies thereon, without stacking, for example, as described in U.S. Pat. No. 4,660,963. This type of copying finds particular use with respect to copying two documents placed on a platen for sequential copying, sometimes referred to as two-up copying.

Book style duplex copying, as used herein refers to the production of duplex copy sets which are suitable for reading as a book from top to bottom from the same sheet edge, with the image top portion on both sides of the sheet adjacent the top edge of the sheet, for binding along a side edge with respect to the image. This portrait style image appearance is generally only achieved in the present duplex-capable reproduction machines, however, when copy sheets are fed through the reproduction processor to receive image information on one or both sides of the copy sheet with the image top to bottom alignment or orientation, as the image is normally viewed, oriented on the sheet transverse to the direction of sheet feeding. When duplex copies are made with image top to bottom alignment oriented on the sheet in the direction of sheet travel in the same reproduction machines, the resulting two-sided copies do not have the top portions of the image along a common edge of the sheet. Instead, the image top portions are adjacent opposed edges on each side of the sheet, which, when the copy set is bound along a side edge in a book style format, provides the second sides of the sheets upside down with respect to the first sides of the sheets. This type of copying sometimes called military style duplex, and hereinafter referred to as pad style duplex, provides easy viewing only if the copy set is bound along the top edge and read by turning pages upwardly to read the back side of each sheet. While pad style duplex copying has certain applications, it is frequently undesirable in duplex copying usage.

Heretofore, in duplex capable copying machines where it has been desirable to provide book style duplex copying from simplex originals, it has been necessary for the machine to provide a paper path and processor accommodating LEF (long edge first) sheets and place images on the sheet having a top to bottom alignment oriented transverse to the direction of sheet travel. This arrangement adds significantly to the cost of the machine, as it requires the paper path and processing elements to accommodate the long edge of sheets fed through the machine. In very low cost machines it is desirable to provide only a narrow processor, accommodating for example, $8\frac{1}{2}\times 11$ inch sheets fed SEF (short edge first). The width of the paper path and processing elements in such a machine are only required to accommodate the $8\frac{1}{2}$ inch length of the sheet as opposed to a machine required to accommodate at least 11 inch widths to accommodate the long edge feed of $8\frac{1}{2}\times 11$ inch sheets. However, this narrow process width arrangement c-dinarily precludes the desirable book style duplex from simplex documents, as the bulk of simplex documents copied have images oriented with the image top portion adjacent a short edge of the document sheet. Alternatively, an operator desiring to produce duplex copies from simplex documents on SEF sheets, must manually rotate every other document to be copied by 180° prior to copying. This is inconvenient, and potentially confusing, allowing the possibility of operator errors. Additionally, such an arrangement precludes the simple use of automatic document feeders to feed the set of documents to be copied past the platen, as an operator seeking to take advantage of the increased speed in automatic document handling must manually prepare the set of simplex documents to be copied with every other sheet rotated with respect to the previous sheet, and re-order the document set subsequent to copying.

PRIOR ART

Xerox Disclosure Journal, Vol. 4, No. 1, January/-February 1979, "Duplex Photocopier," E. R. Brook et al. describes a photocopier having automatic duplex-copying capability in which the copy paper is fed short edge first so that the copy paper must be transported from the transferring nip after simplex copying inverted and returned to the nip retaining the same lead edge. After the first side is transferred, the copy paper is transported away from the transfer nip rotated through 180° on a transport moved sideways at right angles to its previous direction of feed and rotated through 180° about its long axis and deposited into a buffer tray. The first side copies are then fed out of the tray and rotated once again through 180° and returned to the transfer nip for the second side image.

While this apparatus is capable of providing book style duplex with portrait style images from short edge feed apparatus, it suffers from a productivity or thruput deficiency in that during the transition from inverting the first copy about its short edge to inverting it about its long edge and the transition between inverting it about its long edge to inverting it about short edge two large gaps between successive sheets equal to the largest dimension of the print will necessarily be formed since a successive print cannot be fed until the preceding print has totally left its place in the paper path. This can be overcome by increasing the rate of print transport with a corresponding increase in manufacturing cost as a result of requiring more structurally sound and precise apparatus requiring more power and greater precision in timing. Furthermore, the increase in speed would inevitably lead to problems with respect to increased jam rates, increased risk of damage to lighter weight print stocks and other problems with regard to print transport. In addition, in such a system as described in the Brooke et al. disclosure, the print with the first image on it travels over a rather long paper path and inevitably will be laterally moved or skewed or otherwise come out of alignment during its travel which potentially may result in increased paper jam as well as misregistration.

SUMMARY OF THE INVENTION

In accordance with the principle aspect of the present invention, an automatic printing machine for producing successive duplex prints is provided which has means for forming an image on a print substrate, means for feeding successive print substrates to the image forming means to form an image on a first side of successive print substrates and a substrate transport path to transport successive substrates having images on a first side to the image forming means to form images on the opposite side of the substrate which includes means to invert each successive substrate twice about an axis perpendicular to the direction of the path and a side shifting inverter to invert successive substrates once about an axis parallel to the path direction and a means associated with the side shifting inverter to enable the corners of successive substrates entering and exiting the side shifting inverter to be overlapped by substrates being transported in the path direction through the inverter.

In accordance with a further aspect of the present invention, the substrate transport sequentially includes means to invert successive substrates about an axis perpendicular to the direction of the transport path, the side shifting inverter to invert successive substrates about an axis parallel to the path direction and a second means to invert successive substrates about an axis perpendicular to the direction of the path.

In a further aspect of the present invention, the overlapping of the corners of the substrates is enabled by providing a substrate entrance for substrates approaching to the side shifting inverter at a higher level than the level of substrate transport inverter perpendicular to the direction of the path and providing the substrate exit from the side shifting inverter at a higher level than the level of substrate transport from the inverter parallel to the path direction.

In a further aspect of the present invention, the substrate transport path includes a stationary registration wall to register successive substrates along an edge parallel to the direction of the substrate transport path.

In a further aspect of the present invention, the substrate transport path is trayless.

In a further aspect of the present invention, the side shifting inverter comprises at least one driven rotatable member an upper substrate guide means comprising an upper bottom baffle and an upper top baffle to guide a substrate from the substrate entrance to the rotatable member, an arcuate guide member to guide a substrate around the rotatable member and a lower substrate guide means comprising a lower bottom baffle and lower top baffle to guide a substrate from the rotatable member to the substrate exit.

In a further aspect of the present invention, the side shifting inverter and a portion of the substrate transport path on each side of the side shifting inverter are included in a removable cassette which may be interchangeable with a print substrate cassette.

Other features of the present invention will become apparent as the following description and proceeds upon reference to the drawings.

DESCRIPTION OF THE PREFERRED EMBODIMENT

The invention will now be described with reference to a preferred embodiment of the automatic printing machine with a duplex path with a side shifting inverter.

Figure 1:
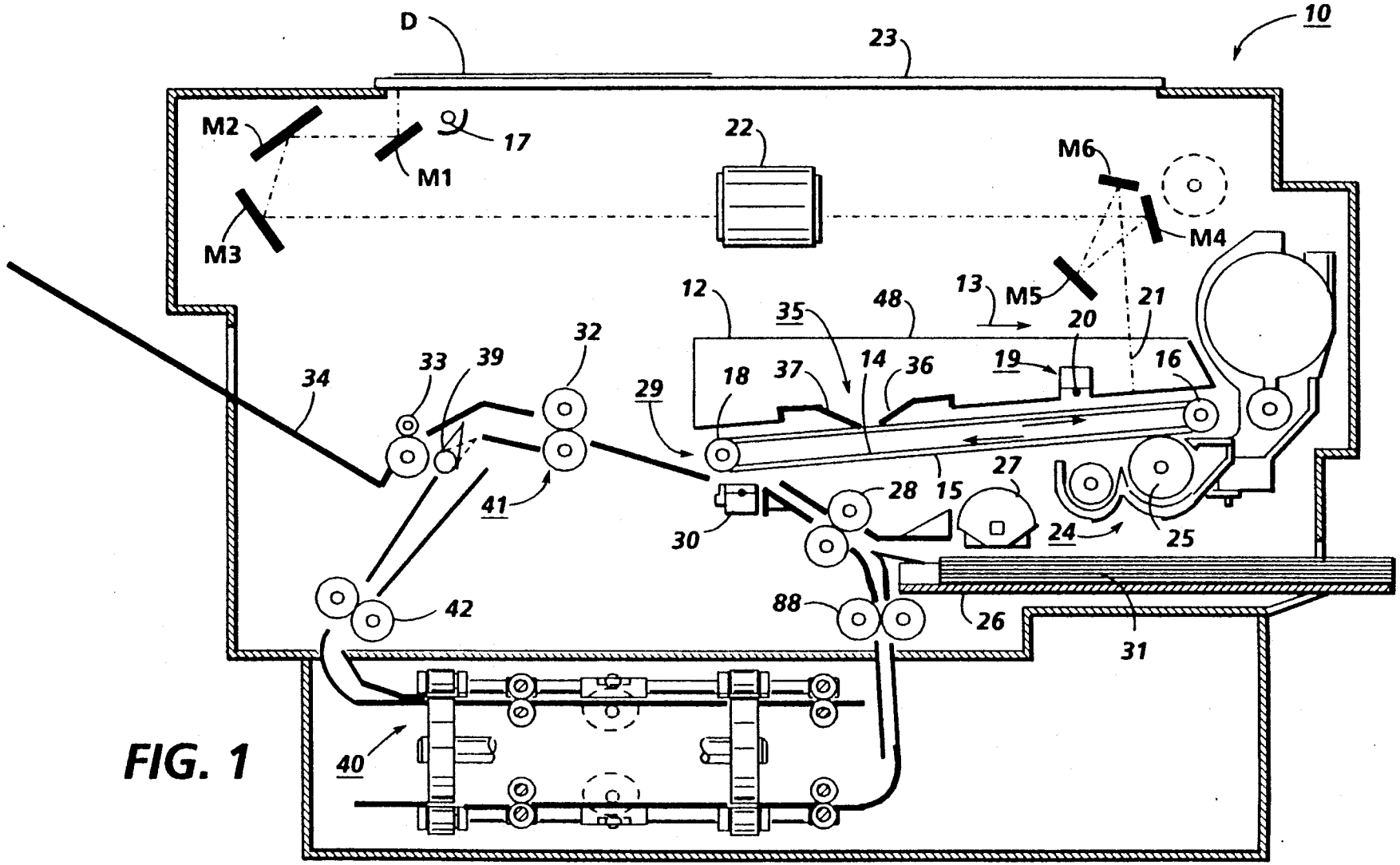
FIG. 1 is a schematic representation in cross section of an automatic printing machine with the duplex path and side shifting inverter according to the present invention.

Referring now to FIG. 1, there is shown by way of example, an automatic electrostatographic reproducing machine 10 illustrating the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems such as electronic printers and is not necessarily limited in application to the particular embodiment or embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a a scanning carriage (not shown)to scan the original document D on the imaging platen 23, lens 22 and mirrors $M_4$, $M_5$, $M_6$ to transmit the image to the photoconductive belt in known manner. The speed of the scanning carriage and the speed of the photoconductive belt are synchronized to provide a faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles.

Sheets 31 of the final support material are supported in a stack arranged on elevated stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as the belt passes around the idler roll 18, and the sheet containing the toner image thereon is advanced to fixing station 41 wherein roll fuser 32 fixes the transferred powder image thereto. After fusing the toner image to the copy sheet the sheet 31 may be advanced by output rolls 33 to sheet stacking tray 34 or alternatively to duplex path side shifting inverter 40.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within cleaning housing 48 which has a cleaning seal 37 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic copier 10 which can embody the apparatus in accordance with the present invention.

The operation of the duplex path side shifting inverter 40 will be described with continued reference to FIG. 1 and additional reference to the remaining Figures.

Figure 2:
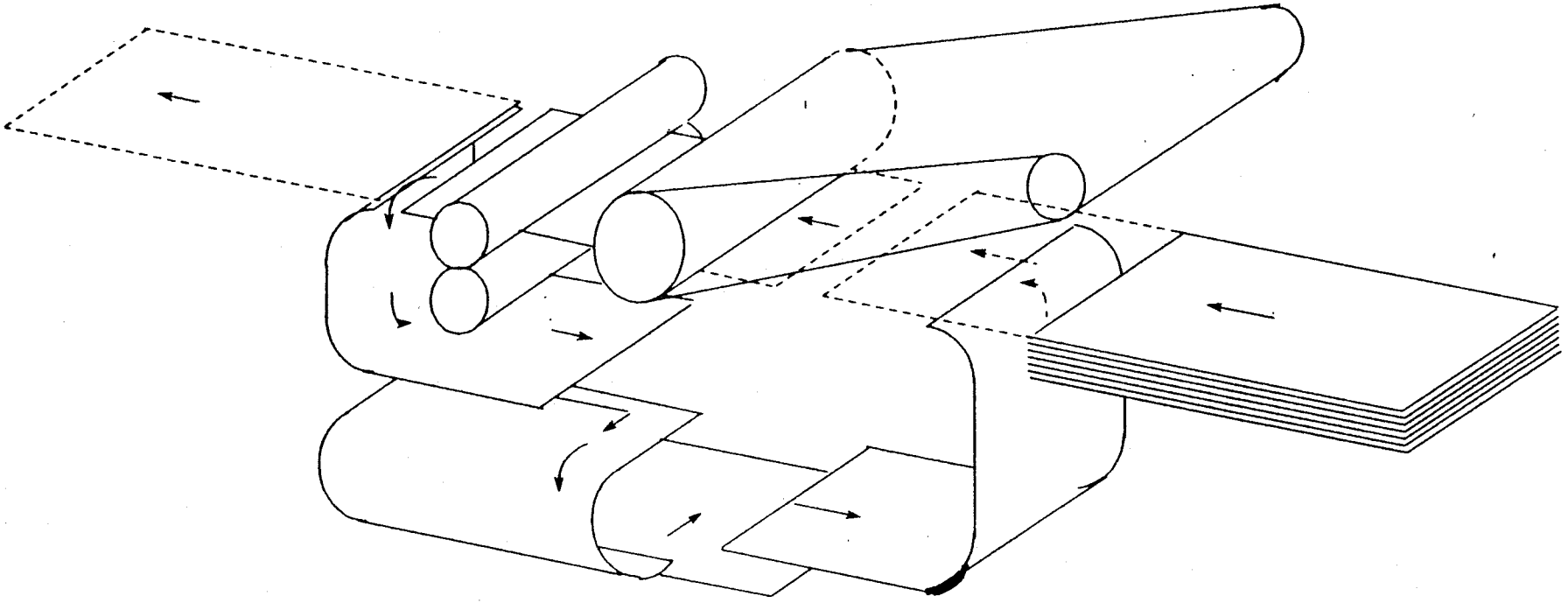
FIG. 2 is an isometric representation of the print substrate duplex path.

FIG. 2 is an exploded isometric representation of the print substrate path from the support tray 26 through the printing machine 10 to receive a first image on a first side, through an inversion about an axis perpendicular to the direction of the path, through a side shifting inverter 40 where the print substrate is inverted about an axis parallel to the path direction and finally through a second inversion about an axis perpendicular to the direction of the path to arrive in the print substrate path just upstream of the first processing station in the printing machine, the belt 14, to receive a second image on the opposite side of the print substrate to form the duplex print.

The mechanism to provide such a print substrate path is illustrated in FIGS. 3A, 3B, 4A, 4B, 5A, 5B, 5C and 6. Following fusing of the toner image on the print substrate, it is directed by decision gate 39 to either tray 34 or through output rolls 42 to the side shifting inverter 40. As print substrate 31 enters the inverter through entry chute 76 and is guided by upper top baffle 43 and upper bottom baffle 44 in a generally horizontal direction. See FIG. 3A. There are two pairs of rightward driving nip rolls 49, 47, 46, 45 along the inboard side of the inverter to transport the substrate across baffle 44.

Figure 3A:
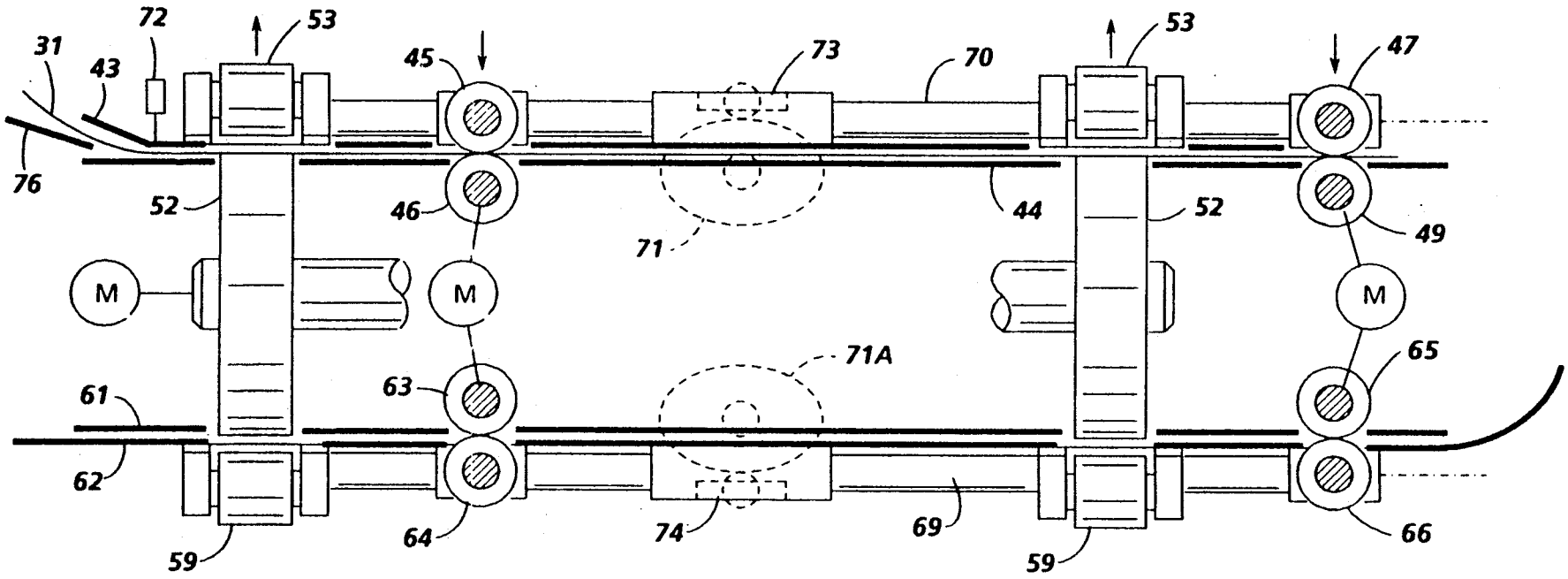
FIGS. 3A and 3B are front and side elevational views respectively of the side shifting inverter with the rightward driving nip rolls engaged and the forward driving idler rolls disengaged.
Figure 3B:
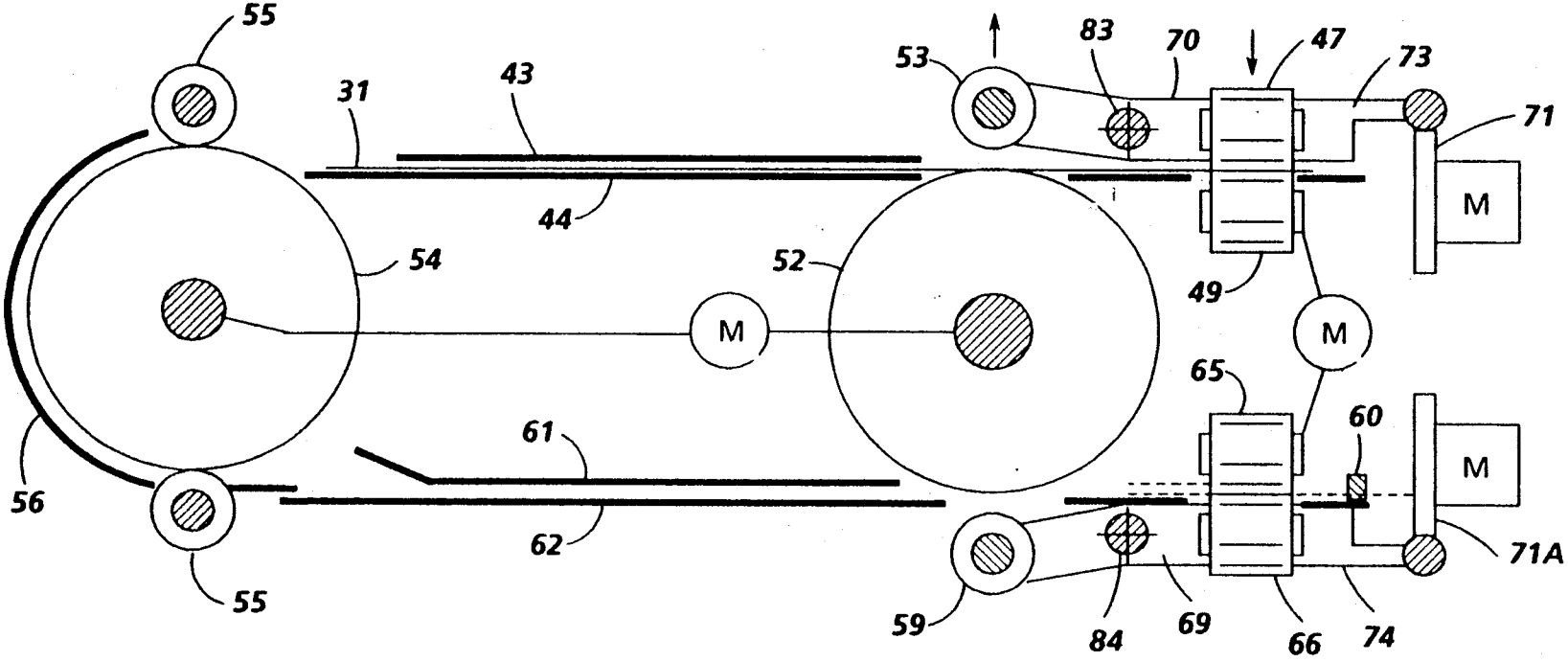
Figure 4A:
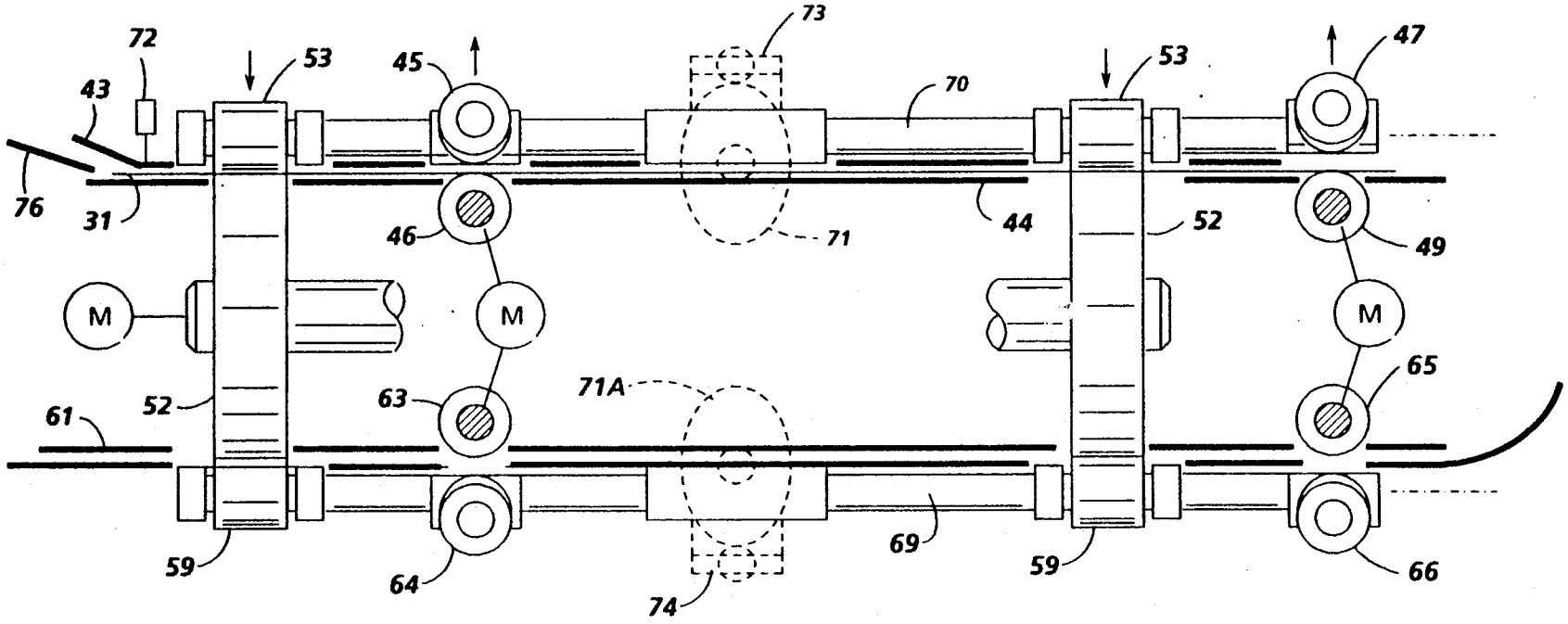
FIGS. 4A and 4B are front and side elevational views respectively with the rightward driving nip rolls disengaged and the forward an rearward driving idler rolls engaged.
Figure 4B:
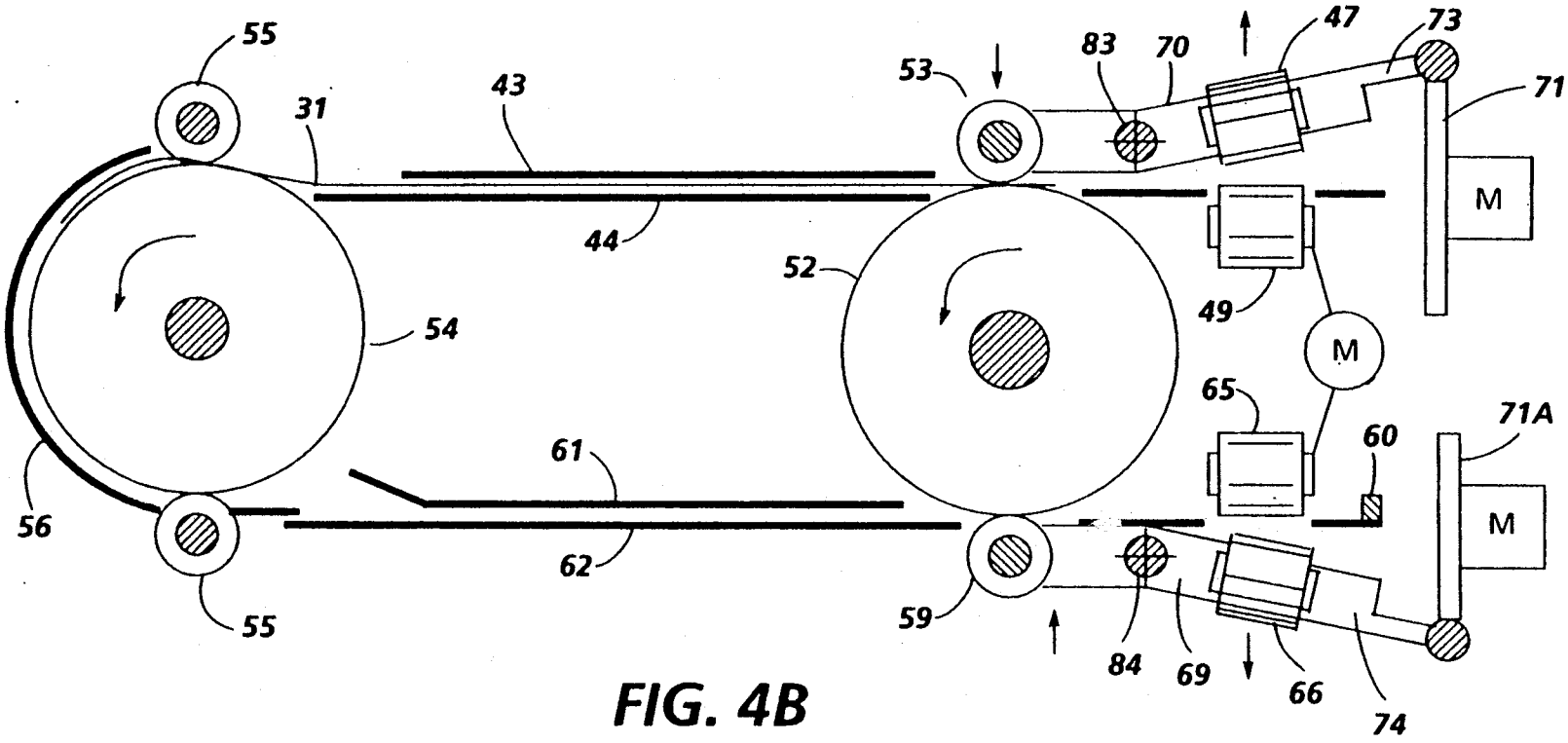

The end view in FIGS. 3B and 4B illustrates a large drive roll 52 to drive the print substrate in a forward direction toward the front of the printing machine as illustrated in FIG. 1. This is accomplished by driving the sheet through the nip formed between drive roll 52 and idler nip roll 53 toward another drive roll 54 with idler nip rolls 55 fixed in contact therewith at the top and bottom to transport a print substrate around the drive roll 54 from top to bottom between it and the turn baffle 56 to invert the substrate about an axis parallel to the direction of the substrate transport path and to change the side edge of the substrate on the inboard side of the substrate path. There is also an idler nip roll 59 which forms a drive nip with large drive roll 52 to drive the substrate toward the rear toward stationary registration edge 60. The print substrate is guided toward the rear of the inverter by being transported between lower top baffle 61 and lower bottom baffle 62. There are two pairs of rightward driving nip rolls 63, 64, 65 and 66 which drive the print substrate out of the inverter back to the processor portion of the printing machine to complete the duplex print.

Above the top driving nip rolls and below the lower driving nip rolls are two toggle carriages 69 and 70 which mount the associated idler rolls 45, 47, 64, 66 for the driving rolls 46, 49, 63, and 65. Carriages 70 is are designed such that either the idlers 45 and 47 associated with the rightward driving rolls are engaged, thus forming driving nips with the driving rolls 46 and 49, or the idler 53 associated with the larger perpendicular driving rolls 52 are engaged, thus forming driving nips to drive sheets in the outboard direction. Carriage 69 is designed such that either idlers 64 and 66 associated with the righward driving are engaged thus forming driving nips with driving rolls 63 and 65 or idlers 59 associated with larger perpendicular driving rolls 52 are engaged thus forming driving nips to drive substrates rearward toward registration edge 60. At no time should the idlers be engaged to drive a substrate both to the right and perpendicular to that direction, to the front or rear, at the same time. Whenever any part of any substrate is being driven by a fixed position nip the toggle carriage should not be positioned to drive that substrate in a perpendicular direction.

The toggle carriages are each pivoted about pivot points 83 and 84 cycled by cams 71 and 71*a* each driven by a motor M. Before the cams are cycled, the idlers 45 and 47 are engaged on the rightward driving nips so they can assist the drive rolls 46 and 49 in driving the substrate to the right on the way into the inverter, or idlers 64 and 66 engaged with drive rolls 63 and 65 to drive the substrate out of the inverter. (See FIGS. 3A and 5C.) When the trail edge of a substrate entering the inverter passes a switch 72 cam 71 is cycled by the motor to move the upper toggle carriage in such a way as to disengage the rightward driving idlers 45 and 47, and immediately engage the frontward idlers 53 (see FIGS. 4A and 4B) with drive roll 52. This toggle action occurs during the first quadrant of cam rotation, after which the cam continues to rotate, but the follower 73 experiences a dwell such that the frontward driving nips remain engaged. While the toggle follower is still on the dwell of the cam, the lead edge of the substrate reaches the nip between drive roll 54 and idler 55 and the substrate is transported to the front and around the turn baffle 56 of the inverter. Thereafter, the toggle follower 73 experiences another ramp on the last quadrant of the cam and this toggles the idlers back to their initial position with the rightward driving nips engaged and the frontward driving nips disengaged. This should not happen, however, until the trail edge of the substrate has passed the rightward driving nips. Futher, the rightward driving nips should be re-engaged before the least edge of the next substrate reaches the frontward driving roll. After moving the upper toggle carriage 70 back to its initial position, the cam 71 has completed one full revolution and stops until the trail edge of the next substrate passes switch 72.

When this sequence of the upper toggle carriage is completed and after a fixed time interval the lower toggle carriage 69 is started into motion by the second cam 71*a* driving motor. A ramp on this cam engages the lower toggle carriage follower 74 and moves it such that the rightward driving nip roll pair 63, 64, and 65, and 66 and 66 become disengaged (see FIG. 4A), and the rearward driving nip roll pair 52 and 59 becomes engaged (see FIG. 4B). At this time the follower experiences a dwell on the cam long enough to drive the substrate into the stationary registration edge 60 to reregister it along an edge. The follower 74 experiences another ramp on the cam 71*a* which disengages the rearward driving rolls 52 and 59 and re-engages the rightward driving rolls 63, 64 and 65, and 66. (See FIG. 5C.) The substrate, having been re-registered against the edge 60 is now driven to the right out of the inverter toward the same path back into the processor as a substrate fed from the feeder would take. The lower cam 71*a* after completing one full revolution, is stopped a fixed time interval after the trail edge of the next substrate reaches the switch at 72. The rearward drive 52,59 should not be engaged until the trail edge of the previous substrate moving to the right has cleared the rearward driving roller.

Substrates on the second pass through the processor should not catch up with each other so that there is no gap between the trial edge of one sheet and the lead edge of the next sheet.

To summarize the operation of the inverter illustrated in FIGS. 3A, 3B, 4A, 4B, 5A and 5B, FIGS. 3A and 3B illustrate the position of the idler rolls and substrate as the substrate initially enters the inverter. The arrows in the several Figures indicate the respective directions in which the several idlers have been moved by the cam mechanism to reach the illustrated position.

Figure 5A:
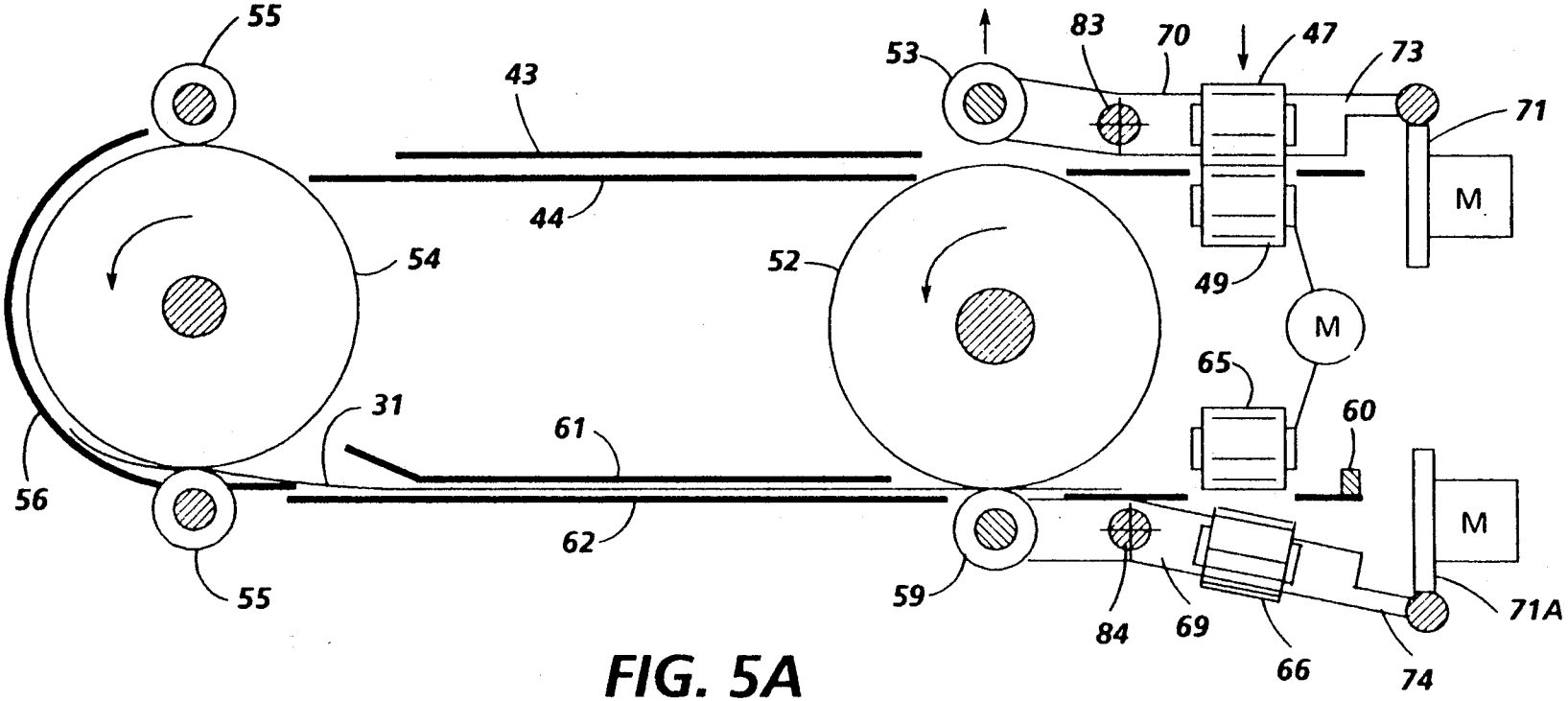
FIG. 5A is a side elevational view depicting the transport of the substrate toward the registration edge and FIG. 5B is a side elevational view showing registration of the substrate, disengagement of the rearward driving idler rolls and engagement of the idlers with the bottom right hand driven rolls.
Figure 5B:
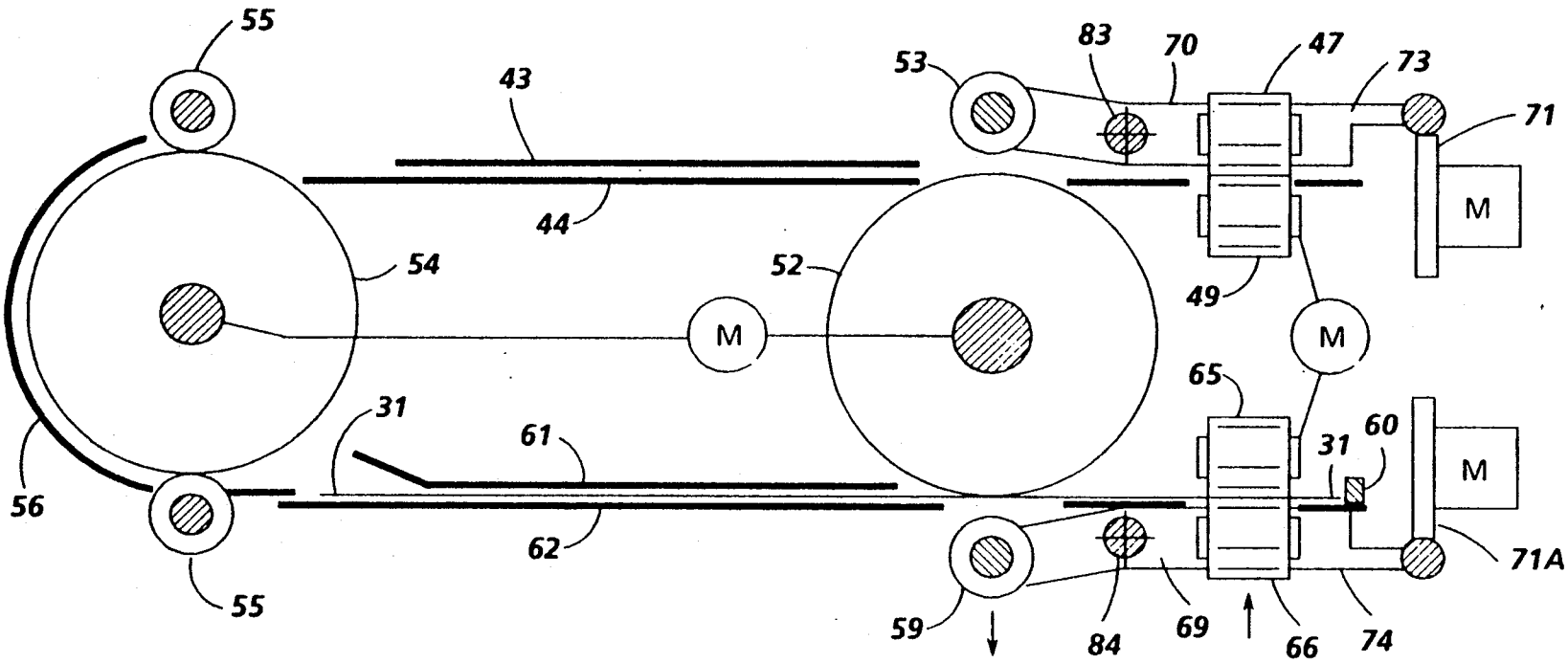
Figure 5C:
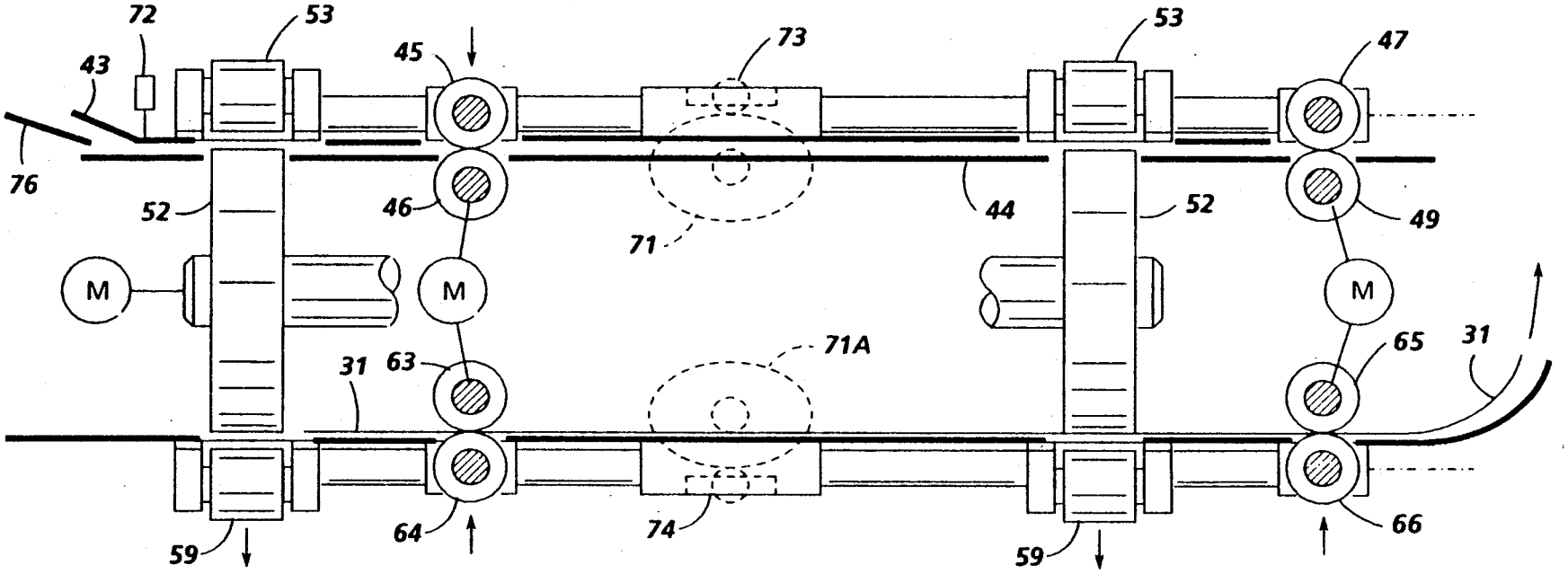
FIG. 5C is a front elevational view showing the transport of the inverted side shifted substrate toward the processor portion of the printing machine by the bottom rightward driven rolls.

FIGS. 4A and 4B illustrate disengagement of idlers 45 and 47 and the engagement of idlers 53 with rolls 52 to transport of the substrate toward the front of the inverter and around the turn baffle. FIG. 5A illustrates the transport of the substrate toward the registration edge with idlers 59 engaged with roll 52. FIG. 5B depicts the registration of the substrate, the disengagement of the idlers from the large drive roll and the engagement of the idlers with the bottom rightward drive rolls. Finally, FIG. 5C illustrates the transport of the inverted, side shifted substrate toward processor portion of the printing machine.

Figure 6:
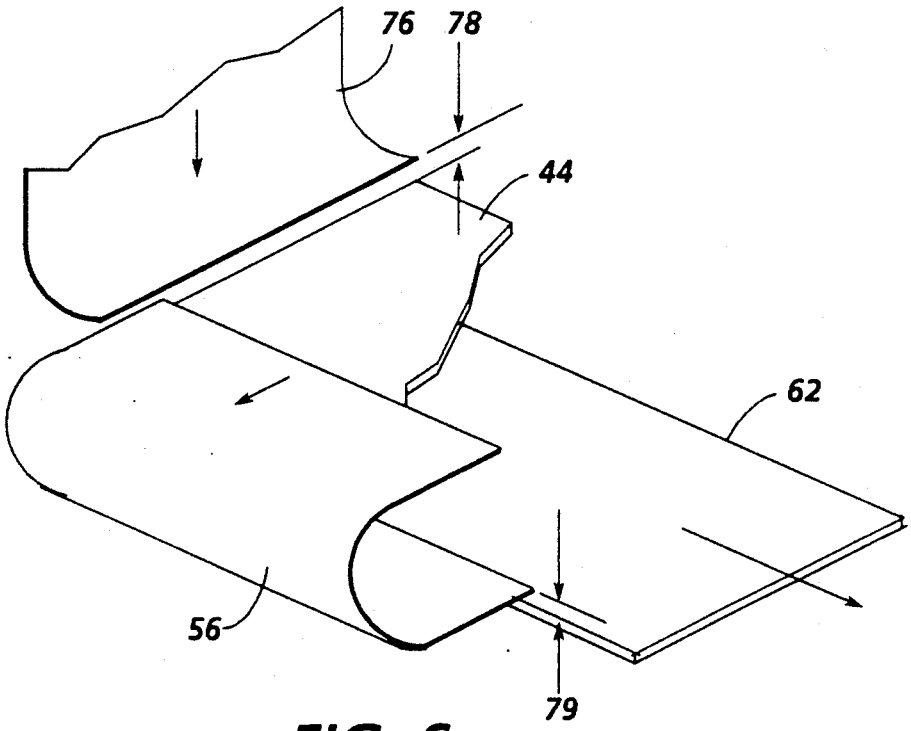
FIG. 6 is a partial isometric representation of the side shifting inverter illustrating the different substrate transport levels to enable substrate overlap.

As illustrated in FIG. 6, as the substrates enter and exit the inverter, the corners are overlapped by traveling in a perpendicular direction through the inverter. On the input side of the inverter, the substrates entrance to the inverter is higher than the plane on which the substrate are transported perpendicularly. In other words, the trail edge will fall off a cliff 78 as soon as it exits the entry chute 76. As mentioned previously, the frontward toggling action is initiated a fixed time interval after the trail edge passes the switch 72. Thus, the trail edge of all sizes of substrates will be in the same location near the input to the inverter before they begin to move to the front of the inverter path. Accordingly, the lead edge of the next incoming substrate is capable of traveling over the top of the frontward moving substrate while avoiding edge to edge contact, even if the edge of that substrate is slightly curled. Typically the cliff is of the order of from about 15 to 20 mm. A similar cliff 79 is provided in the lower/exit path of the inverter so that the level of substrate transport in the inverter perpendicular to the direction of the path is at a higher level than the level of transport from the inverter parallel to the path direction. Thus lead edge of an incoming substrate moving to the rear will pass over the top of the trail edge of the previous sheet traveling perpendicularly to it as it exits the inverter.

Figure 7:
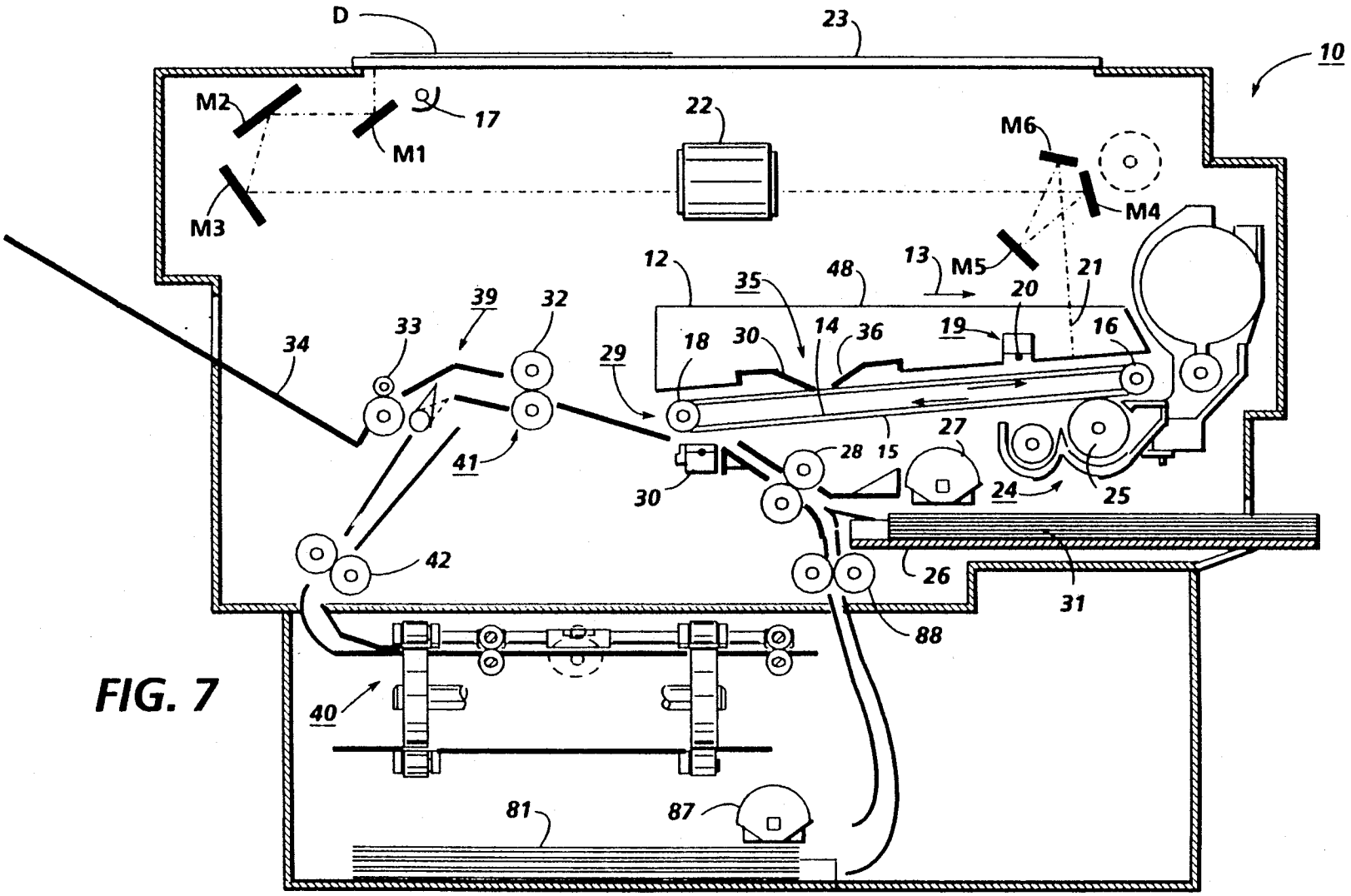
FIG. 7 is schematic representation like FIG. 1 representing the use of a duplex buffer tray rather than a trayless duplex path.

While FIG. 1 illustrates the trayless duplex path within the automatic printing machine wherein successive print substrates having images formed on a first side are immediately returned to the printing machine to have subsequent images formed on the opposite side, FIG. 7 illustrates the alternative embodiment wherein a print substrate buffer tray 81 is provided in the transport path for collecting successive print substrates with an image on the first side preparatory to feeding the substrates through the image forming means to form images on the opposite side of the substrate. In this embodiment the print substrates are collected in the tray after they are inverted and fed toward the registration edge by nip pair 54,55. Accordingly, the cam 71*a*, motor and carriage assembly can be removed. The individual sheets are fed by feed roll 87 toward transport rolls 88.

Figure 8:
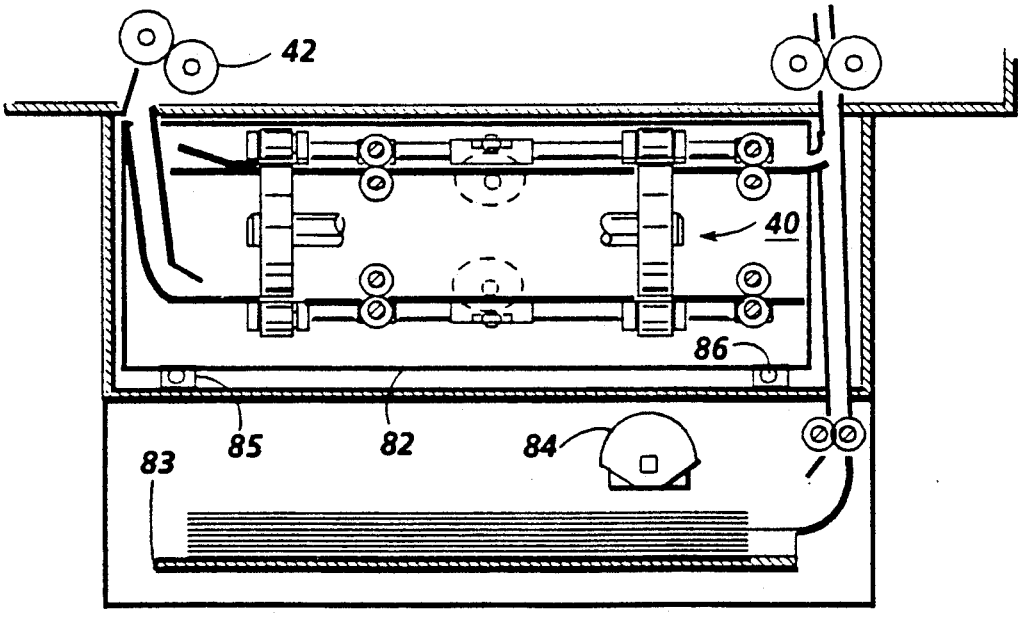
FIG. 8 illustrates an alternative embodiment where the side shifting inverter is included in a removable cassette and the substrate entrance to the inverter is in the lower portion of the inverter.

FIG. 8 illustrates a further alternative embodiment wherein the side shifting inverter 40 and a portion of the substrate transport path on each side of the side shifting inverter are included in a cassette 82 which is removable from the printing machine by sliding out and moving in on tracks 85 and 86. The cassette may be interchangeable with a print substrate paper feeder cassette. In addition, this Figure illustrates the further alternative embodiment wherein the substrate entrance to the inverter is in the lower portion of the inverter rather than the upper portion as is illustrated in FIGS. 1 and 2 and the inversion in the side shifting inverter about an axis parallel to the path direction is from bottom to top. This geometry may be successfully operated by overlapping the corners as was shown in FIG. 6 through the same mechanism of introducing the substrate to the entrance of the inverter at a higher level than the level of substrate transport in the inverter perpendicular to the direction of the path and having a substrate exit from the inverter also at a higher level than the level of substrate transport from the inverter parallel to the path direction. With a cassette containing a duplex path, it is possible to provide an automatic printing machine having a multifunctional capability in that it may at the user's option have a standard or regular paper cassette inserted in the machine for regular simplex printing or alternatively at the user's choice be replaced with a duplex path cassette providing the capability of duplex printing. Also illustrated in FIG. 8 is a further paper tray 83 and a segmented feed roll 84 which provides an alternative print substrate.

Thus, according to the present invention, an automatic duplex capability has been provided wherein book style duplex with portrait style images and pad style duplex with landscape images can be obtained in a printing machine that feeds print substrates short edge first. Furthermore, according to the present invention, improved efficiency and productivity are obtained by the elimination of large gaps between successive print substrates. The present invention enables the transport of print substrates at reasonable speeds with very small gaps between successive substrates which is highly reliable and can be economically manufactured. Furthermore, since according to the present invention, it is not necessary to increase the speed of the print substrate transport to increase the time between the trail edge of one substrate and the lead edge of the next substrate to avoid collisions as substrates traverse the inverter, the propensity to experience problems in substrate transport including increased jam rates or risk of damage to lightweight papers is reduced. Additional economies are experienced with a reduction in precision of parts and power requirements. In a further aspect of the present invention, an automatic registration or reregistration system along the long edge of a print substrate is provided. This will further insure correct alignment of the print substrate throughout the transport path. In addition, the capability of providing a duplex path within a removable cassette which provides the user with not only the flexibility of having an automatic machine which in addition to providing simplex prints has separate duplex print capability. This capability is achieved merely by adding a feature to a removable cassette rather than having to bear the expense of a separate duplex device. Further, the duplex path cassette may be interchangeable with a regular print substrate cassette.

The disclosures of the patents and other documents referred to herein is hereby specifically and totally incorporated herein by reference.

While the invention has been described with reference to specific embodiments, it will be apparent to those skilled in the art that many alternatives, modifications and variations may be made. For example, while the invention has been illustrated with reference to a printing machine wherein the electrostatic latent image is formed by optically scanning an original it will be appreciated that the electrostatic latent image may be created in other ways such as by a modulated beam of light from a laser beam. Accordingly, it is intended to embrace all such alternatives modifications as may fall within the spirit and scope of the appended claims.

I claim:

1. Automatic printing machine for producing successive duplex prints comprising means for forming an image on a print substrate, means for feeding successive print substrates to said image forming means to form an image on a first side of successive print substrates, means defining a substrate transport path to transport successive substrates having images on a first side to said image forming means to form images on the opposite side of said substrate, said substrate transport path including means to invert each successive substrate twice about an axis perpendicular to the direction of said path, a side shifting inverter to invert successive substrates once about an axis parallel to said path direction and means associated with said side shifting inverter to enable the corners of successive substrates entering and exiting the side shifting inverter to be overlapped by substrates being transported in the path direction through the inverter.

2. The printing machine of claim 1 wherein said substrate transport path includes means to register successive substrates along an edge parallel to the direction of the substrate transport path.

3. The printing machine of claim 2 wherein said means to register comprises a stationary registration wall.

4. The printing machine of claim 1 wherein said substrate transport path sequentially includes means to invert successive substrates about an axis perpendicular to the direction of said path, said side shifting inverter to invert successive substrates about an axis parallel to said path direction and a second means to invert successive substrates about an axis perpendicular to the direction of said path.

5. The printing machine of claim 4 wherein said means to enable the corners to be overlapped comprises a substrate entrance to the inverter at a higher level than the level of substrate transport in said inverter perpendicular to the direction of said path and said substrate exit from the inverter is at a higher level than the level of substrate transport from said inverter parallel to said path direction.

6. The printing machine of claim 5 wherein said side shifting inverter comprises at least one driven rotatable member, an upper substrate guide means comprising an upper bottom baffle and an upper top baffle to guide a substrate from the substrate entrance to the rotatable member, an arcuate guide member to guide a substrate around said rotatable member and a lower substrate guide means comprising a lower bottom baffle and a lower top baffle to guide a substrate from said rotatable member to the substrate exit.

7. The printing machine of claim 6 wherein said substrate transport path includes a substrate entrance, at least one first drive roll driven in the direction of said substrate transport path downstream said substrate entrance, at least one first idler roll movable into and out of engagement with said drive roll to form a substrate drive nip therebetween, at least one second drive roll driven in a direction perpendicular to said transport path, at least one second idler roll movable into and out of engagement with said second drive roll to form a substrate drive nip therebetween said idler rolls being mounted on a pivotable toggling carriage to alternately engage one of said at least one first and second drive roll to form a drive nip therebetween and means to toggle said carriage to alternately engage said at least one first and second drive roll said toggling carriage being mounted to enable engagement of said drive rolls with said idler rolls through apertures in said upper bottom baffle.

8. The printing machine of claim 7 wherein said idler rolls are mounted on a pivotable toggling carriage to alternately engage one of said at least one first and second drive roll to form a drive nip therebetween and means to toggle said carriage to alternately engage said at least one first and second drive roll said toggling carriage being mounted to enable engagement of said drive rolls with said idler rolls through apertures in said upper bottom baffle.

9. The printing machine of claim 7 wherein said substrate transport path includes a substrate exit, at least one third drive roll driven in the direction of said substrate transport path upstream of said exit, at least one third idler movable into and out of engagement with said drive roll to form a substrate drive nip therebetween, at least one fourth drive roll driven in a direction perpendicular to said transport path, at least one fourth idler roll movable into and out of engagement with said fourth drive roll to form a substrate drive nip therebetween.

10. The printing machine of claim 9 wherein said idler rolls being mounted on a pivotable toggling carriage to alternately engage one of said at least one third and fourth drive roll to form a drive nip therebetween and means to toggle said carriage to alternately engage said at least one third and fourth drive roll, said toggling carriage being mounted to enable engagement of said drive rolls with said idler rolls through apertures in said lower top baffle.

11. The printing machine of claim 1 wherein said substrate transport path is trayless.

12. The printing machine of claim 1 further including a print substrate buffer tray in said substrate transport path for collecting successive print substrates with an image on a first side preparatory to feeding said substrates to said image forming means to form images on the opposite side of said substrate.

13. The printing machine of claim 1 wherein said side shifting inverter and a portion of said substrate transport path on each side of said side shifting inverter are included in a cassette removable from the printing machine.

14. The printing machine of claim 13 wherein said cassette is interchangeable with a print substrate cassette.

15. The printing machine of claim 13 wherein said substrate transport path includes means to register successive substrates along an edge parallel to the direction of the substrate transport path.

16. The printing machine of claim 15 wherein said means to register comprises a stationary registration wall.

17. The printing machine of claim 13 wherein said substrate transport path sequentially includes means to invert successive substrates about an axis perpendicular to the direction of said path, said side shifting inverter to invert successive substrates about an axis parallel to said path direction and a second means to invert successive substrates about an axis perpendicular to the direction of said path.

18. The printing machine of claim 16 wherein said means to enable the coroners to be overlapped comprises a substrate entrance to the inverter at a higher level than the level of substrate transport in said inverter perpendicular to the direction of said path and said substrate exit from the inverter is at a higher level than the level of substrate transport from said inverter parallel to said path direction.

19. The printing machine of claim 18 wherein said side shifting inverter comprises at least one driven rotatable member, an upper substrate guide means comprising an upper bottom baffle and an upper top baffle to guide a substrate from the substrate entrance to the rotatable member, an arcuate guide member to guide a substrate around said rotatable member and a lower substrate guide means comprising a lower bottom baffle and a lower top baffle to guide a substrate from said rotatable member to the substrate exit.

20. The printing machine of claim 13 wherein said substrate transport path is trayless.

21. The printing machine of claim 13 further including a print substrate buffer tray in said substrate transport path for collecting successive print substrates with an image on a first side preparatory to feeding said substrates to said image forming means to form images on the opposite side of said substrate.

22. The printing machine of claim 19 wherein said substrate transport path includes a substrate entrance, at least one first drive roll driven in the direction of said substrate transport path downstream said substrate entrance, first idler roll movable into and out of engagement with said drive roll to form a substrate drive nip therebetween, at least one second drive roll driven in a direction perpendicular to said transport path as second idler roll movable into and out of engagement with said second drive roll to form a substrate drive nip therebetween.

23. The printing machine of claim 22 wherein said idler rolls being mounted on a pivotable toggling carriage to alternately engage one of said at least one first and second drive roll to form a drive nip therebetween and means to toggle said carriage to alternately engage said at least one first and second drive roll said toggling carriage being mounted to enable engagement of said drive rolls with said idler rolls through apertures in said upper bottom baffle.

24. The printing machine of claim 22 wherein said substrate transport path includes a substrate exit, at least one third drive roll driven in the direction of said substrate transport path upstream of said exit, third idler movable into and out of engagement with said drive roll to form a substrate drive nip therebetween, at least one fourth drive roll driven in a direction perpendicular to said transport path, a fourth idler roll movable into and out of engagement with said fourth drive roll to form a substrate drive nip therebetween.

25. The printing machine of claim 24 wherein said idler rolls being mounted on a pivotable toggling carriage to alternately engage one of said at least one third and fourth drive roll to form a drive nip therebetween and means to toggle said carriage to alternately engage said at least one third and fourth drive roll, said toggling carriage being mounted to enable engagement of said drive rolls with said idler rolls through apertures in said lower top baffle.

26. A duplex cassette for use in an automatic printing machine for producing duplex prints, said cassette including a portion of the duplex print substrate path including a side shifting inverter to invert successive substrates once about an axis parallel to the path direction, and means associated with said side shifting inverter to enable the coroners of successive substrates entering and exiting the side shifting inverter to be overlapped by substrates being transported in the path through the inverter.

27. The cassette of claim 26 wherein said substrate transport path includes means to register successive substrates along an edge parallel to the direction of the substrate transport path.

28. The cassette of claim 27 wherein said means to register comprises a stationary registration wall.

29. The cassette of claim 26 wherein said means to enable the coroners to be overlapped comprises a substrate entrance to the inverter at a higher level than the level of substrate transport in said inverter perpendicular to the direction of said path and said substrate exit from the inverter is at a higher level than the level of substrate transport from said inverter parallel to said path direction.

30. The cassette of claim 29 wherein said side shifting inverter comprises at least one driven rotatable member, an upper substrate guide means comprising an upper bottom baffle and an upper top baffle to guide a substrate from the substrate entrance to the rotatable member, an arcuate guide member to guide a substrate around said rotatable member and a lower substrate guide means comprising a lower bottom baffle and a lower top baffle to guide a substrate from said rotatable member to the substrate exit.

31. The cassette of claim 30 wherein said substrate transport path includes a substrate entrance, at least one first drive roll driven in the direction of said substrate transport path downstream said substrate entrance, at least one first idler roll movable into and out of engagement with said drive roll to form a substrate drive nip therebetween, at least one second drive roll driven in a direction perpendicular to said transport path, at least one second idler roll movable into and out of engagement with said second drive roll to form a substrate drive nip therebetween, said idler rolls being mounted on a pivotable toggling carriage to alternately engage one of said at least one first and second drive roll to form a drive nip therebetween and means to toggle said carriage to alternately engage said at least one first and second drive roll said toggling carriage being mounted to enable engagement of said drive rolls with said idler rolls through apertures in said upper bottom baffle.

32. The cassette of claim 31 wherein said idler rolls are mounted on a pivotable toggling carriage to alternately engage one of said at least one first and second drive roll to form a drive nip therebetween and means to toggle said carriage to alternately engage said at least one first and second drive roll said toggling carriage being mounted to enable engagement of said drive rolls with said idler rolls through apertures in said upper bottom baffle.

33. The cassette of claim 31 wherein said substrate transport path includes a substrate exit, at least one third drive roll driven in the direction of said substrate transport path upstream of said exit, at least one third idler movable into and out of engagement with said drive roll to form a substrate drive nip therebetween, at least one fourth drive roll driven in a direction perpendicular to said transport path, at least one fourth idler roll movable into and out of engagement with said fourth drive roll to form a substrate drive nip therebetween.

34. The cassette of claim 33 wherein said idler rolls being mounted on a pivotable toggling carriage to alternately engage one of said at least one third and fourth drive roll to form a drive nip therebetween and means to toggle said carriage to alternately engage said at least one third and fourth drive roll, said toggling carriage being mounted to enable engagement of said drive rolls with said idler rolls through apertures in said lower top baffle.

* * * * *